United States Patent [19]

Glaesener

[11] 4,047,701

[45] Sept. 13, 1977

[54] END ASSEMBLY FOR ROADWAY GUARD RAIL

[75] Inventor: Ernest Glaesener, Differdange, Luxembourg

[73] Assignee: Arbed - Acierles Reunies de Burbach-Eich-Dudelange S.A., Luxembourg, Luxembourg

[21] Appl. No.: 626,872

[22] Filed: Oct. 29, 1975

[30] Foreign Application Priority Data

Oct. 31, 1974 Luxembourg ..... 229

[51] Int. Cl.[2] ..... B66F 3/08

[52] U.S. Cl. ..... 256/13.1

[58] Field of Search ..... 256/13.1

[56] References Cited

U.S. PATENT DOCUMENTS

| | | | |
|---|---|---|---|
| 3,369,634 | 2/1968 | Mazelsky | 256/13.1 X |
| 3,603,562 | 9/1971 | Glaesener | 256/13.1 |
| 3,704,861 | 12/1972 | Glaesener | 256/13.1 |
| 3,705,709 | 12/1972 | Andriussi | 256/13.1 |
| 3,784,167 | 1/1974 | Glaesener | 256/13.1 |

FOREIGN PATENT DOCUMENTS

| | | | |
|---|---|---|---|
| 232,030 | 7/1963 | Austria | 256/13.1 |
| 1,534,540 | 9/1969 | Germany | 256/13.1 |

*Primary Examiner*—Wayne L. Shedd

*Attorney, Agent, or Firm*—Karl F. Ross; Herbert Dubno

[57] ABSTRACT

The end of a roadway guard rail which is spaced above and extends generally parallel to the ground is rigidly secured to a rigid beam at least 25 m long having a far end sunk in the ground and supported between its ends by a plurality of vertically compressible posts. The beam may be a metal shell filled with synthetic-resin foam. The posts may be provided internally with shock absorbers, or with springs, or may be made of sheet metal with a synthetic-resin core. In any case the posts are vertically compressible so as to absorb the kinetic energy of a vehicle colliding with the beam in order to slow the vehicle down without flipping it over. The upper surface of the beam is provided with a friction layer that further aids in slowing down a colliding vehicle.

5 Claims, 3 Drawing Figures

END ASSEMBLY FOR ROADWAY GUARD RAIL

CROSS-REFERENCE TO RELATED APPLICATIONS

This application is related to my copening patent applications Ser. No. 559,510 (now abandoned) and Ser. No. 559,590 (now U.S. Pat. No. 3,966,173) both filed 18 Mar. 1975.

FIELD OF THE INVENTION

The present invention relates to a guard rail, and more particularly, to an end assembly for a guard rail.

BACKGROUND OF THE INVENTION

In a roadside barrier having a guard rail held above and parallel to the ground by a plurality of breakaway posts, the end of the guard rail turned toward the oncoming traffic passing the rail creates a considerable hazard. When a vehicle collides with the rail at any location other than the end of the rail the posts snap off and the considerable kinetic energy of the vehicle is absorbed by the entire rail so as to slow down and gently stop the vehicle without ricoheting it back into the traffic.

When the end of the guard rail is merely allowed to project beyond the end post it is usually necessary to provide some protective arrangement such as shock-absorbing blocks or the like. This projecting end otherwise constitutes a considerable hazard for a motor vehicle striking it.

It has also been suggested to bend the guard rail down at its end and bury it in the ground. Although this prevents the rail from impaling a vehicle colliding with it, it has the extremely dangerous effect of prying the vehicle up and often flipping it over in its own traffic lane or in the opposite traffic lane. The vehicle merely rides up the bent-down end section until it is overturned or simply launched over the guard rail.

OBJECTS OF THE INVENTION

It is therefore an object of the present invention to provide an improved roadside barrier.

Another object is the provision of an improved end assembly for a guard rail as described in my above-mentioned patent applications and in my U.S. Pat. No. 3,704,861 issued 5 Dec. 1972.

Yet another object is the provision of an end assembly for a guard rail which will prevent a motor vehicle from being impaled on the end of the guard rail and will also not deflect or overturn a motor vehicle colliding with the assembly.

SUMMARY OF THE INVENTION

These objects are attained according to the present invention in an end assembly for a guard rail which comprises a generally straight beam which is at least 25 m long and has one end secured to the end of the guard rail and the other end seated in or on the ground with the beam inclined to the ground downwardly from the rail to its other end. At least one support or post is provided between the ends of the beam with its upper end or side secured to the beam and its lower end or side seated on the ground and this post is provided with means between its upper and lower ends allowing it to shorten vertically when compressed vertically with a force exceeding a predetermined level. Thus at least a portion of the kinetic energy of a vehicle colliding with the beam is absorbed by the post as it collapses.

According to another feature of this invention the beam is of the metallic shell type having an outer profiled metal shell which may be filled with synthetic-resin foam. Such a structure is extremely rigid and, when made of sheet steel having a thickness of up to 6 mm, may be used without a synthetic-resin filling; when sheet steel of between 1 mm and 3 mm thickness is used, a hard polyurethane foam filling imparts to it sufficient strength to allow the beam to withstand even severe collisions without breaking. In both cases the beam remains relatively yieldable so that it deforms and absorbs the kinetic energy of a vehicle colliding with it. Regardless of the construction of the beam the posts are made of the breakaway type so that the kinetic energy of a colliding vehicle is transmitted through the entire structure.

In accordance with further features of this invention the beam is in force-transmitting relationship with the guard rail. To this end a separate post may be provided between the upper end of the end-assembly beam and the guard rail in order to fit different cross-sectional shapes together. It is also possible to use a beam of identical construction as the guard rail.

According to yet another feature of the present invention the posts are each formed of two telescoping parts, one seated on the ground and one connected to the beam. Between these parts there is provided an elastic element such as a hydraulic or pneumatic shock absorber or a spring. It is also possible to use a post having formations allowing it to be vertically collapsed, this effect being achieved by forming the posts as a succession of inwardly and outwardly concave ad convex regions. Posts are spaced between 2 m and 8 m apart so that at least two posts are provided for each end assembly.

The support in accordance with the present invention may be a block or a stack of wedge-shaped blocks preferably of synthetic-resin material. These blocks are fitted together and glued so as to form a rigid but compressible base for the beam. The base may have an overall triangular shape, with at least its upper surface inclined to its lower surface to allow the post to extend at right angles from the inclined beam.

According to yet another feature of the present invention at least the end post of the guard rail to which the end assembly is attached is also vertically compressible. Thus, a vehicle which collides with the end assembly will not be flipped over but will be cushioned and brought to a relatively gentle halt as the posts collapse and the beam deforms. Even if the vehicle has sufficient momentum to ride past the entire 25-meter end assembly, the guard rail itself will collapse to absorb the kinetic energy of the colliding vehicle without throwing the vehicle back into either of the traffic lanes or turning the vehicle over.

According to the present invention the upper surface at least of the end assembly is provided with a coating having a high coefficient of friction. Thus the upper surface may be formed with a synthetic-resin layer having a fibrous filler so as to act as a brake shoe frictionally slow down a colliding vehicle. Even after the end assembly has been partially crushed it retains much of its energy-absorbing properties, so that it can still serve to slow down another colliding vehicle before the beam has been straightened out and posts replaced or expanded.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
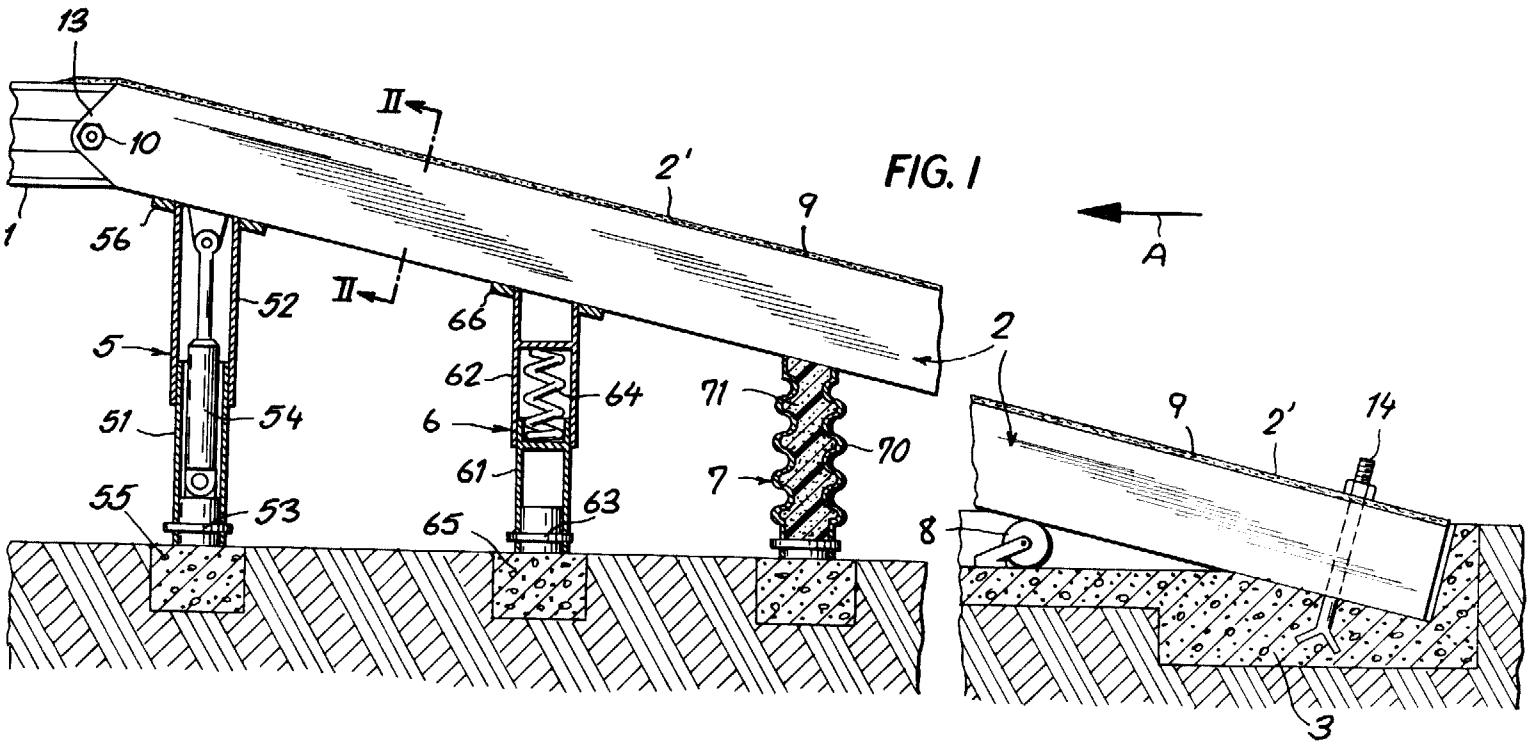
FIG. 1 is a vertical section through an end assembly in accordance with this invention.

As shown in FIG. 1 a guard rail as described in my U.S. Pat. No. 3,704,861 has an end connected rigidly via a bolt 10 to a rectangular-section beam 2. This beam 2 is at least 25 m long and has a far end fitted into a seat 3 of concrete set in the ground so that the planar upper surface 2' of this beam 2 starts at the ground level and is inclined gently upwardly to the upper surface of the guard rail 1.

Figure 2:
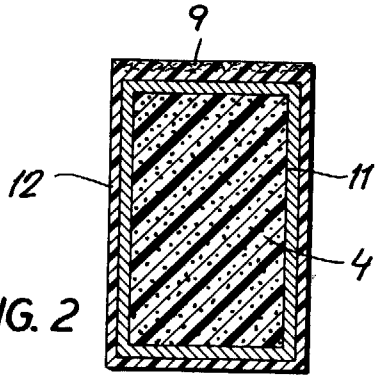
FIG. 2 is a section taken along line II—II of FIG. 1 in enlarged scale.

The beam 2 is formed as shown in FIG. 2 of an outer sheet-steel shell 11 of rectangular section 25 cm by 15 cm and having a thickness of 1.2 mm. This shell 11 is filled with a polyurethane foam mass 4 having a volume weight of between 45 and 55 kg/m$^3$, preferably 50 kg/m$^3$.

The beam 2 is supported on posts 5, 6 and 7 and, adjacent the socket 3, on an elastomeric bumper or roller 8. The posts 5, 6 and 7 are between 3 and 4 m apart, here 3.5 m. The post 5 comprises an outer end upper shell 52 in which is telescoped a lower shell 51 secured by means of a breakaway base 53 to a concrete base block 55. A hydraulic shock absorber 54 is engaged between sleeves 51 and 52 to allow the post to contract vertically. The upper sleeve 52 is widened at a flange 56 and bolted to the underside of the beam 2.

The post 6 is similarly formed of inner and outer sleeves 61 and 62, the inner sleeve being secured by means of a breakaway cast-metal base 63 in a concrete footing 65 and the outer sleeve having a mounting flange 66. In this arrangement, however, a compression spring 64 is provided between sections 61 and 62.

The post 7 is unitarily made of sheet metal and is formed with a succession of vertically spaced outwardly concave grooves 70, giving the post the shape of a stack of coaxial hyperboloids. Thus this post is readily vertically deformable, but cannot be reused as once vertically crushed it must be replaced. The element 7 may be filled as shown at 71 with a synthetic-resin material to increase its vertical rigidity.

The upper surface of the beam 2 is provided with a fibrous brake-lining type layer 9 so that a vehicle moving over the beam 2 in the direction of arrow A will be frictionally slowed down by this layer 9. As shown in FIG. 2 the beam 2 is provided with a synthetic-resin skin 12 that protects it from rust and may be continuous with the friction layer 9.

FIG. 1 further shows how the end of beam 2 is formed as an intermediate portion 13 that allows the rectangular-section beam 2 to be fitted to the rail 1 which itself is formed at each side with a horizontally extending and outwardly open groove.

Figure 3:
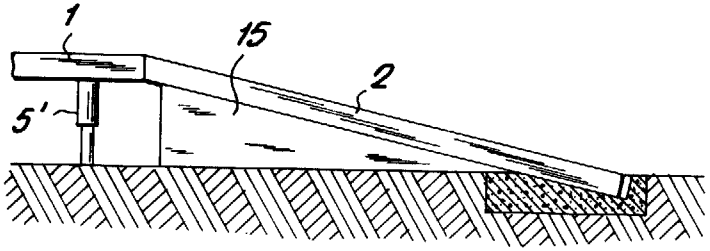
FIG. 3 is a side view partly in vertical section through another end assembly according to the present invention.

Although the free end of beam may (as shown in FIG. 3) lie loose within the wedge-shaped socket formed at the base 3, it is also possible (as shown in FIG. 1) to provide a bolt 14 securing this end in place.

FIG. 3 shows how the end of the guard rail 1 may be supported on a post 5' identical to the post 5. In this case, however, the inclined beam 2 is supported by a single compressible synthetic-resin block 15 made of polyurethane foam. It is possible in such an arrangement to form the beam 2 of the same material as the block 15 and secure this single large triangular element to the end of the rail 1.

I claim:

1. In combination with an elongated guardrail spaced above and extending generally parallel to the ground, an end assembly comprising:

an elongated beam at least 25 meters long and having one end secured to an end of said elongated guardrail at the height thereof above the ground, and another end lying substantially at the level of the ground such that said beam is inclined over its length to the ground from said one end to said other end, said beam being formed as a hollow profile of sheet steel of a thickness of up to 6 mm and being plastically yieldable upon receiving impact by a vehicle to absorb kinetic energy of said imapct by flexure of said beam;

a wedge-shaped socket inset in the ground and receiving said other end of said beam, said socket being formed with an inclined surface along which said other end of said beam is limitedly slidable, and means retaining said other end of said beam against said surface;

a plurality of upright posts spaced apart at distances of 2 to 8 meters from one another disposed directly beneath and coplanar with said beam, each of said posts having an upper end secured to said beam, a lower end fixed to the ground, and means between said ends compressible upon deformation of said beam in a vertical direction by a vehicle riding up on same to absorb at least a portion of the kinetic energy of said vehicle, said posts contracting vertically only upon the application of a compressive force thereto enabling said beam to yield vertically in response to a vehicle riding up upon said beam.

2. The combination defined in claim 1, further comprising a mass of polyurethane foam filling said sheet-metal profile.

3. The combination defined in claim 2 wherein said post consists of a pair of telescoping tubes and a spring urging said tubes apart.

4. The combination defined in claim 2 wherein at least one of said posts consists of a pair of telescoping tubes and a fluid-responsive device between said tubes resisting the telescoping thereof together.

5. The combination defined in claim 2 wherein at least one of said posts is a corrugated metal tube filled with a compressible synthetic-resin mass.

* * * * *